United States Patent [19]

Bacroix et al.

[11] 4,456,040

[45] Jun. 26, 1984

[54] TAP DEVICE FOR CONTAINER TREATMENT INSTALLATION PARTICULARLY FOR CARBONATED BEVERAGE BOTTLES

[75] Inventors: Marcel Bacroix, Audincourt; Joseph Menini, Seloncourt; Serge Lagoutte, Buxy, all of France

[73] Assignee: Pont-A-Mousson S.A., Nancy, France

[21] Appl. No.: 225,153

[22] Filed: Jan. 14, 1981

[30] Foreign Application Priority Data

Jan. 17, 1980 [FR] France ..... 80 00957

[51] Int. Cl.[3] ..... B65B 43/50; B65B 43/60; B65B 37/02

[52] U.S. Cl. ..... 141/150; 141/164; 141/171; 141/172; 141/272; 141/377

[58] Field of Search ..... 141/129–191, 141/250–284, 285–310, 377, 14; 53/279, 282, 283, 272, 276

[56] References Cited

U.S. PATENT DOCUMENTS

| | | | |
|---|---|---|---|
| 967,049 | 8/1910 | Pindstofte | 141/150 |
| 967,050 | 8/1910 | Pindstofte | 141/150 |
| 969,572 | 9/1910 | Stöckel et al. | 141/150 X |
| 991,664 | 5/1911 | Strasburger | 141/377 X |
| 1,135,102 | 4/1915 | Engelhardt | 141/150 X |
| 1,154,374 | 9/1915 | Cerruti | 141/150 X |
| 1,949,536 | 3/1934 | Ferguson | 53/279 |
| 2,415,528 | 2/1947 | Peebles et al. | 141/140 X |
| 3,421,555 | 1/1969 | Minard et al. | 141/172 X |

*Primary Examiner*—Horace M. Culver

*Attorney, Agent, or Firm*—Sughrue, Mion, Zinn, Macpeak and Seas

[57] ABSTRACT

The tap device 1 consists in an articulated mechanism 23 which positions each plastic bottle 5 against the corresponding spigot 22 in a tilted position. The aeration and foaming of the carbonated liquid beverage are thus decreased, filling is more stable, and the star-wheel for removal 3 may be provided with a capper 42 using screw-tops.

5 Claims, 9 Drawing Figures

TAP DEVICE FOR CONTAINER TREATMENT INSTALLATION PARTICULARLY FOR CARBONATED BEVERAGE BOTTLES

BACKGROUND OF THE INVENTION

The present invention relates to tapping devices used in equipping treatment installations for bottles or analogous containers intended principally for carbonated liquids. These tappers generally include at least one spigot fed from a reservoir of liquid, one loading device which transports the bottles in a vertical position to the vicinity of the spigot, and a device to carry the bottles to the filling position as well as a device for removal of the bottles.

In the known tappers of this type, the bottles are brought beneath the spigot in a vertical position. This results in excessive aeration of the liquid, which has a tendency to adhere to the inside surface of the bottle and form a "liquid bubble" which is relatively unstable, the source of turbulence, oxidation and foaming. These phenomena are particularly troublesome in the case of large capacity bottles (1 liter or more) intended to contain carbonated beverages.

SUMMARY OF THE INVENTION

The purpose of the invention is to provide a tapping device which substantially reduces the aeration of the liquid during filling. To this end, its objective is a tapper of the type referred to above which is characterized by the fact that the loading device includes arrangements whereby each bottle can temporarily be tilted.

Preferably, the loading device and removal device follow a trajectory which is offset horizontally with respect to the spigot. This imparts an important advantage: once the filling has been completed, when the bottle is returned to the vertical position, the space above it is free. Arrangements can therefore be made to provide, immediately after the spigot, a capping device for the final closure of the bottles, in particular a device for the application of screw-tops, which reduces the gas losses to a minimum.

The device is applicable in particular to installations in which there is continuous bottle movement, i.e., to tappers in which the spigot is borne by a support tangent to the loading device and removal device and movable in synchronization with them. In this case, the loading device may quite simply be an articulated mechanism borne by the mobile support and controlled by a fixed cam.

DETAILED DESCRIPTION OF THE PREFERRED EMBODIMENT

Figure 1:
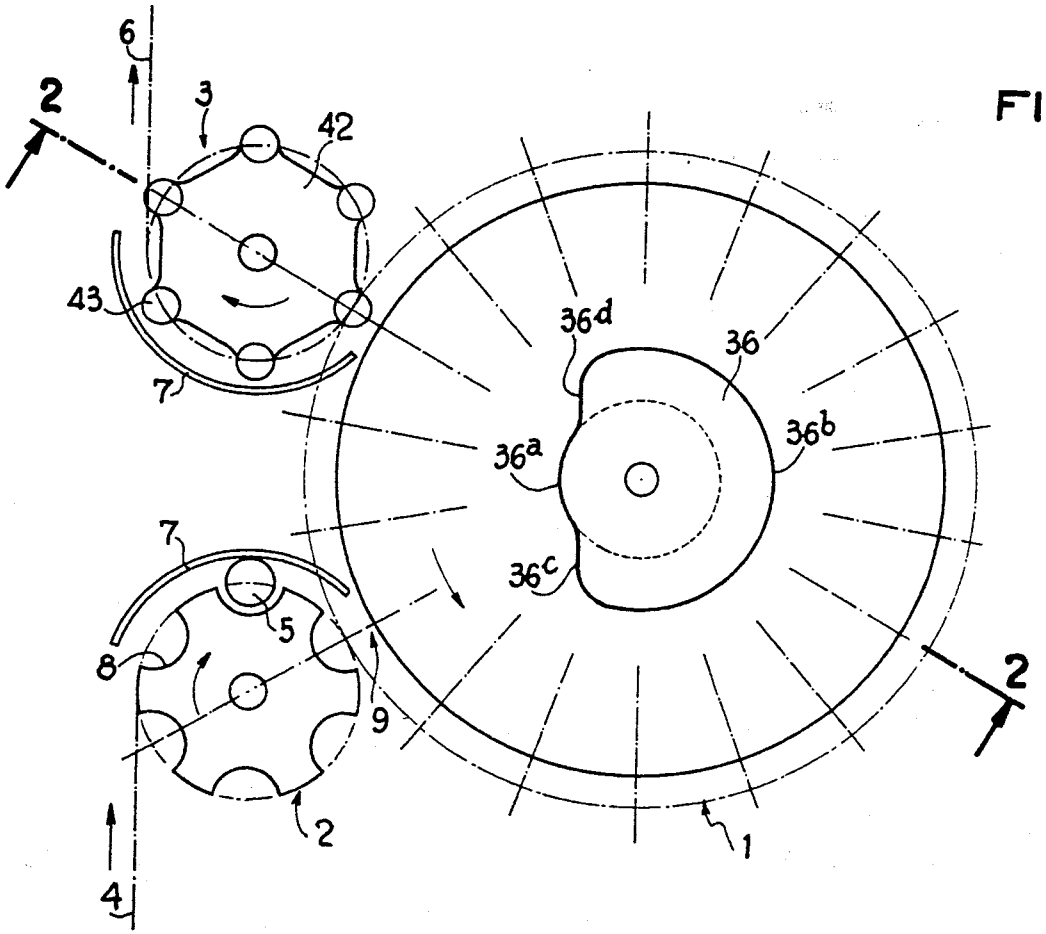
FIG. 1 is a schematic plan view of a bottle treatment installation including a tapper according to the invention.

FIG. 1 shows that portion of a treatment installation for plastic bottles for carbonated beverages which involves the filling and capping of the bottles. This part of the installation basically is made up of a rotary tapping device 2 with a notched disk or "star-wheel" for loading, and a notched disk or "star-wheel" 3 for removal. The star-wheel 2 is fed by an input conveyor 4 which brings in empty bottles 5, while the star-wheel 3 releases the filled and capped bottles 5 to an output conveyor 6. Curved guides 7 ensure that the bottles are correctly transferred between these various devices.

For purposes of clarity, a single bottle 5 has been represented in FIG. 1, but in reality the bottles 5 follow one another in an uninterrupted fashion of the conveyor 4 and occupy in succession the semicircular cavities or notches 8 in the star-wheels 2 and 3. Each cavity 8 corresponds to a tapping position 9 of the tapping device 1, and the movements proceed synchronously in the direction of the arrows.

Figure 2:
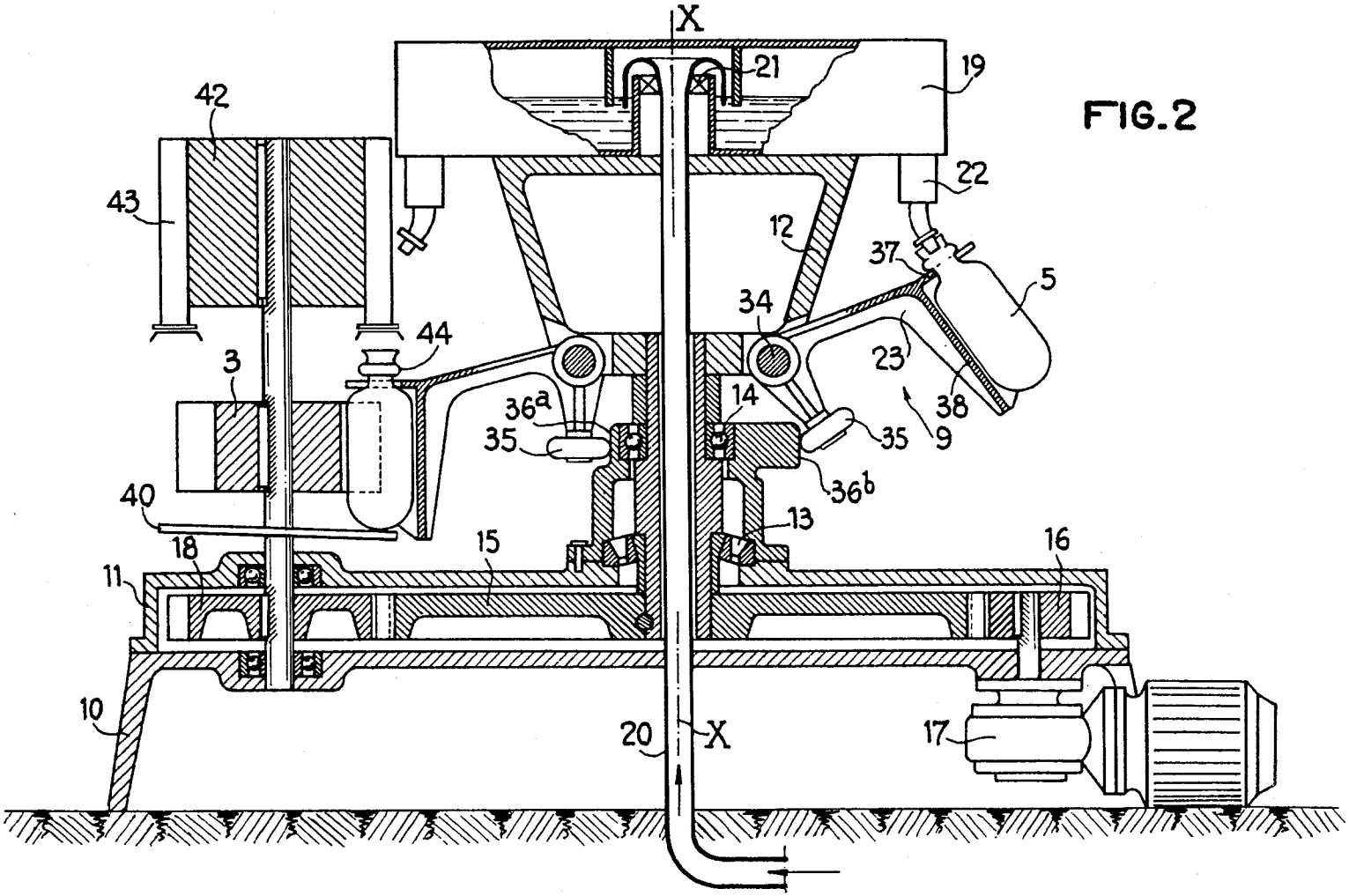
FIG. 2 is a cross sectional view along line 2—2 of FIG. 1.

As seen in FIG. 2, the tapper 1 consists of a fixed frame 10, 11 which carries a rotating frame 12 with vertical axis X—X mounted on roller bearings 13, 14. The frame 12 is driven by a toothed crown 15. The latter, contained within the frame 10, 11, is activated by a pinion 16 connected to a motorized reducing gear 17 and itself operates a pinion 18 keyed to the removal star-wheel 3 and an analogous pinion (not visible in the drawings) keyed to the loading star-wheel 2.

On its upper portion, the frame 12 has a vat or feed-tank 19 provided with liquid through a fixed conduit 20 with axis X—X mounted by a turning joint 21 and provided with appropriate units (not represented) to control the flow and regulate the level. In a variant, the vat 19 could be fed from above.

Each tapping position 9 includes a spigot 22 and an articulated bottle-holding mechanism 23.

The spigot 22 (FIG. 3) consists of a vertical tubular body 24 whose upper end is attached around an opening in the lower wall of the vat 19 and whose lower extremity is at a slant. An intermediate section of the bore 26 of the body 24 forms a seat for a coaxial valve 27 controlled by a cam (not represented).

On the lower extremity of the body 24 is the plane, circular base 28 of a nozzle unit 29 which has a neck 30 perpendicular to its base 28 and tilted downward in relation to the axis of said base. With repect to the tapper 1, the neck 30 is oriented radially and to the outside, and is tilted downward by a large angle $\alpha$ from the vertical, on the order of 45° for example. Its output opening, at an angle, is nearly plane and horizontal. The body 29 has one other conduit 31 of very small diameter which is situated above the nozzle 30 and whose upper end is connected by a conduit (not represented) furnished with a stop valve to the space above the liquid in the vat 19. The lower end of the conduit 31 receives a fixed nozzle 32 of a given length. On the neck 30 is threaded an annular sealing washer 33. A third conduit is provided for in the body 29, and is not visible in the drawing, for purposes of access to the atmosphere, said third conduit also being provided with a stop valve.

Each articulated mechanism 23 is made up of a two-armed lever, shaped like an L, whose angle oscillates about a horizontal axis 34 borne on the mobile frame 12. One arm of the lever has, at its end, a roller 35 which rolls on a fixed peripheral cam 36 on the guiding pin of the frame 12. This cam has a small radius area 36$^a$ which extends between the two star-wheels, a large radius region 36$^b$ which covers about three fourths of a rotation, an area with increasing radii 36$^c$ and a region with decreasing radii 36$^d$. The other arm of the lever has, on the one hand, an almost vertical fork 37, and on the other hand, a virtually vertical wall 38 extending downward and slightly concave, e.g., with a very widely spread V-shape.

Figure 4:
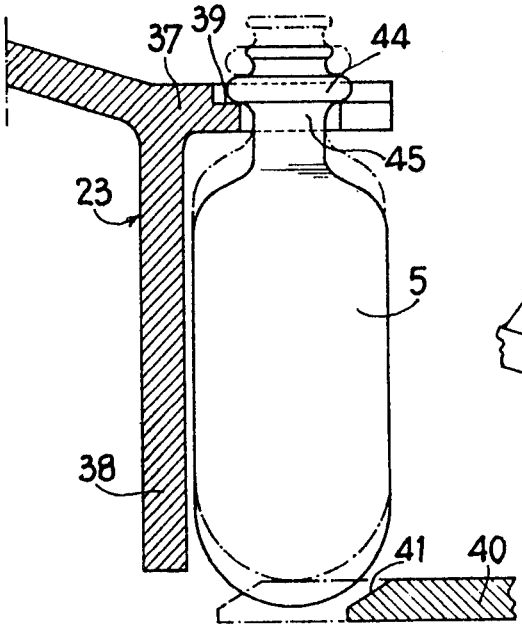
FIG. 4 is a vertical cross section showing a detail of the tapping device.
Figure 5:
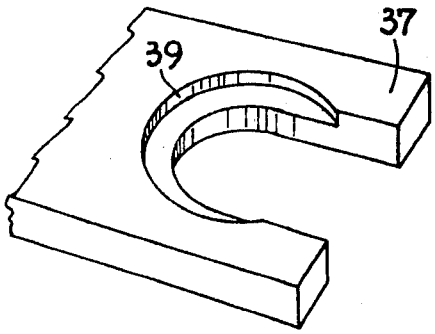
FIG. 5 is a perspective view of a detail of the device shown in FIG. 3.

As seen in FIGS. 4 and 5, the fork 37 forms a groove with parallel sides and a semicircular bottom; around it, in the upper surface, a circular hollow or recess 39 is provided.

Each star-wheel 2,3 includes a bottle-supporting plate 40 which has a chamfered edge 41. The rotation tree of the removal star-wheel also bears, above it, a capping device 42 which is represented schematically and provided with capping units 43 at right angles to each cavity 8 in the star-wheel.

The tapper 1 is intended to fill the bottles 5 with a carbonated liquid, for example a carbonated beverage, contained in the vat 19 under suitable pressure. These bottles are large capacity bottles with a hemispherical bottom made of a plastic material; near their necks they have a small protrusion or collar 44 which tops a cylindrical neck 45 whose height is greater than the thickness of the forks 37.

In operation, each empty bottle 5 arrives vertically suspended by its collar 44 and is deposited by the conveyor 4 on the plate 40 of the star-wheel 2 in one of its cavities 8. After almost one half revolution, the bottle is engaged in the back of the corresponding fork 37, which at that time is horizontal. This brings the collar 44 above the fork 37 (position indicated by alternating dots and dashes in FIG. 4), right at the hollow 39, whose diameter is slightly greater. Then the bottle 5 is moved radially toward the outside with respect to the plate 40 and consequently comes down on the edge 41 thereof, which brings it into the position represented by solid lines in FIG. 4, where it is suspended by its collar 44.

Figure 3:
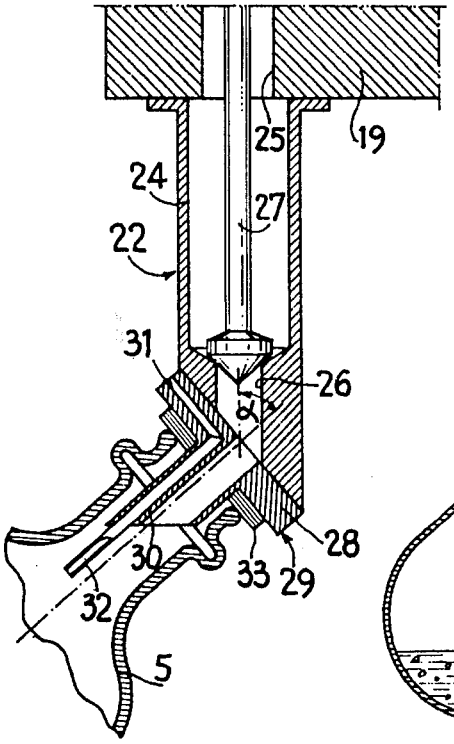
FIG. 3 represents a longitudinal cross section, at a larger scale, of the spigot of a tapping device.

The roller 35, which to this point had been rolling on area 36$^a$ of the cam, at this time arrives at area 36$^c$ thereof, which causes the lever 23 to tip and coaxially brings the neck of the bottle firmly up against the sealing washer 33 of the corresponding spigot (FIG. 3). This is facilitated by the relatively large diameter of the necks of the plastic bottles.

At this time, owing to an appropriate system (not represented) for controlling of the stop valves, the following sequence occurs:

(a) air at the pressure of the vat 19 is introduced into the bottom by the conduit 31;
(b) when isobarometry between bottle 5 and vat 19 is reached, the valve 27 is opened, the liquid flows in, and the excess air escapes through conduit 31 to pass into the vat;
(c) when the level of liquid attained in the conduit 31 is that of the free level of the vat 19, the flowing is stopped;
(d) the valve 27 is closed by its cam; and
(e) the bottle is returned to atmospheric pressure by the conduit for return to the atmosphere.

This sequence takes place during the rolling of the roller 35 on part 36$^b$ of the cam 36, with the larger portion of the bottle body supported by the wall 38 of the mechanism 23. Once the sequence is over, the roller reaches descending ramp 36$^d$, which brings the fork 37 back to a horizontal position and the bottle 5 back to a vertical position. The full bottle 5 is raised onto the plate 40 of the removal star-wheel 3, which disengages its collar 44 from the cavity 39, becomes lodged in a cavity 8 in said star-wheel and is carried away by it. While it is in the star-wheel 3, the bottle receives an appropriate cap in order to resist the pressure of carbonic gas, for example a screw-top, from the capping unit 43 over the star-wheel. The fork 37 which is now free moves toward the loading star-wheel 2 to receive a new empty bottle 5.

Figure 6:
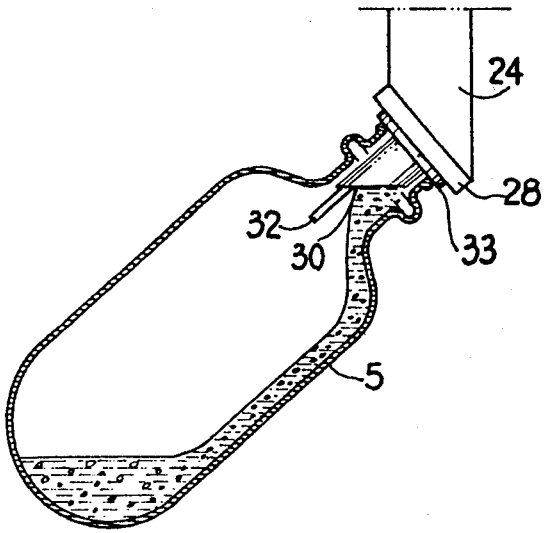
FIG. 6 is a schematic illustration of the flow of the liquid into the bottle.

The tapping device 1 has numerous advantages:

During filling (FIG. 6), the neck 30 is beneath the nozzle 32. The liquid flows freely downward, shortly to run into the tilted inside wall of the bottle and form a more or less compact and stable stream which spreads over only a small part of the periphery of the bottle. The aeration of the liquid is thus minimal, as is the case of its foaming and oxidation; the trajectory of the liquid tends not to interfere with the free end of the nozzle 32, which therefore is not threatened by stoppage.

Also, during filling it is the collar 44 which sustains all the pressures involved with keeping the neck sealed against the sealing washer 33. There is therefore no risk of deforming the main body of the bottle.

The tilting of the necks 30 and the bottles 5 makes it possible to have a smaller diameter for the vat 19 than for the diameter of the circle of displacement of the non-tilted bottles (FIG. 1), which is the original meshing circle of the tapping device with the star-wheels 2 and 3. This completely frees the space above these star-wheels and makes it possible in particular to provide, above star-wheel 3, very tall capping units adapted to carry out pressure resistant capping, in particular to apply screw-tops. It is thus possible to cap each bottle very shortly after its filling is concluded, with a minimal loss of carbonic gas.

Figure 7:
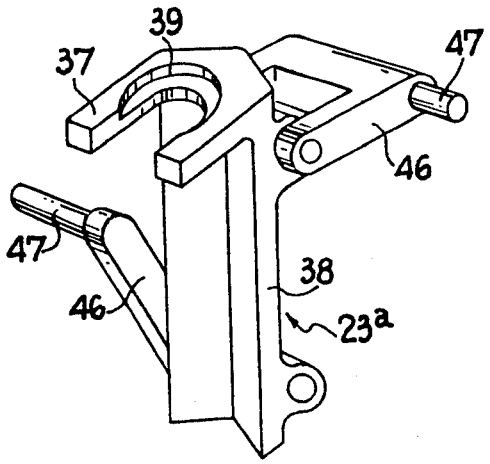
FIG. 7 is a perspective view of a variant of the articulated mechanism in FIGS. 4 and 5.
Figure 8:
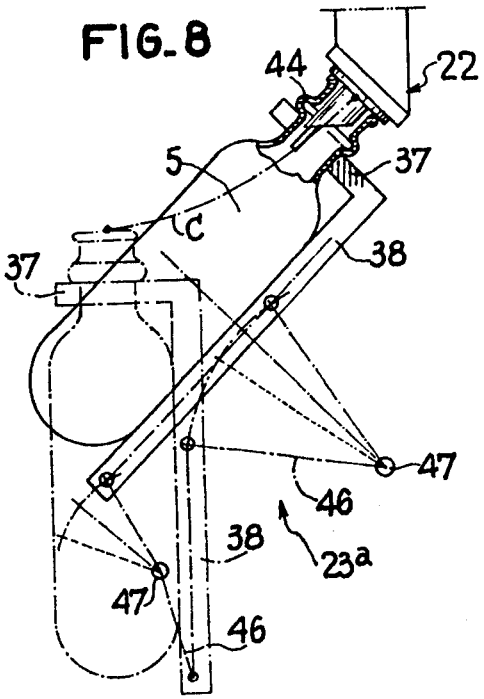
FIG. 8 illustrates the operation of the variant in FIG. 7.

In the variant represented schematically in FIGS. 7 and 8, the rigid bottle-carrying unit of the articulated mechanism 23$^a$, made up of the fork 37 and the wall 38, is connected with the mobile frame 12 by two small links 46 articulated around parallel horizontal axes situated on the rear surface of the wall 38 near each of its ends, upper and lower. The other end of each link 46 is articulated by an axle 47 at a fixed point of the frame 12. The two small links each bear a roller activated by a cam (not represented) to give the bottle the complex movement (a combination of two rotations in the clockwise direction around the two axles 47) illustrated schematically in FIG. 8, where the parabolic-looking curve C has been traced by the center of the bottle neck as it moves to become coaxially positioned around the neck 30.

Figure 9:
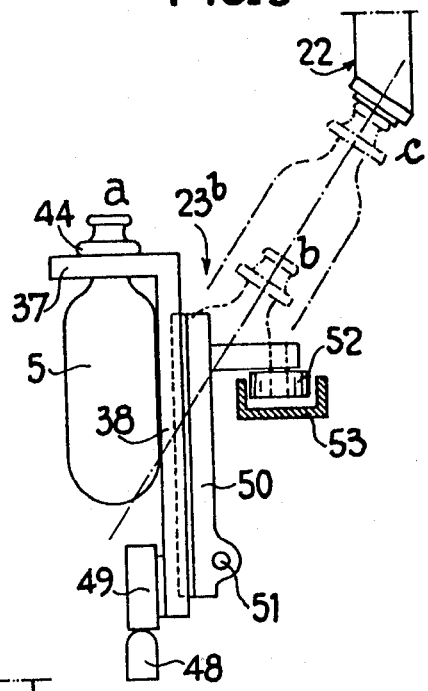
FIG. 9 schematically shows another variant of the articulated mechanism.

In the variant in FIG. 9, the bottle-carrying unit 37–38 of the articulated mechanism 23$^b$ rests on a second cam 48 through the intermediary of a roller 49 and slides in a nearly vertical track 50. The latter is articulated at its base around a horizontal axis 51 of the frame 12 and activated through its upper portion by means of a roller 52 which interacts with a positive cam 53. The interconnections are such that when the bottle 5 is suspended by the fork 37, there is first a tipping a-b followed by a rise b-c along the axis of the neck 30.

Of course, other articulated mechanisms may be used to shift the bottles from the initial low, vertical position to the high, tilted filling position, and vice versa.

What is claimed is:

1. A tapping apparatus for filling bottles (5), particularly with carbonated liquids, comprising:

(a) a movable support (12), (b) a liquid reservoir (19) movable with the support, (c) at least one spigot (22) mounted on and fed by the reservoir, said spigot having an outwardly angled nozzle (30), (d) an input device (2) disposed tangential to the support for transporting a vertically oriented bottle to the support proximate the spigot, said bottle having a body portion and an enlarged diameter collar (44) on a neck portion thereof proximate a fill opening, (e) an output device (3) disposed tangential to the support for removing filled bottles therefrom, (f) an articulated mechanism (23) pivotally mounted to the support and comprising a fork portion (37) for engaging the bottle at the neck portion thereof below the collar to suspend the bottle, and a connected wall portion (38) for laterally supporting the body portion of the bottle, and (g) fixed cam means for engaging and pivoting the articulated mechanism during movement of the spigot between the input and output devices to temporarily angularly incline the bottle for filling engagement with the nozzle.

2. A tapping apparatus according to claim 1, wherein said fork portion includes a circular hollow (39) for matingly engaging said collar (44), and wherein the input (2) and output (3) devices include means (40, 41) for raising the bottle (5) a distance at least equal to the depth of said hollow.

3. A tapping apparatus according to claim 2 or 1, wherein said fork portion (37) and said wall portion (38) are connected to the movable support (12) by two small links (46), one of which is activated by said fixed cam (FIGS. 7–8).

4. A tapping apparatus according to claim 2 or 1, wherein said fork portion (37) and said wall portion (38) are mounted in a tiltable track (50) activated by said fixed cam (53) and supported by a second roller (49) on a cam (48) for lifting the track into its tilted position.

5. A tapping apparatus according to claim 1, wherein the spigot (22) includes a liquid fill tube situated beneath an air conduit (31).

* * * * *